United States Patent [19]

Mode

[11] 4,283,002

[45] Aug. 11, 1981

[54] SELF OPENING CARTON

[75] Inventor: Duane R. Mode, Minneapolis, Minn.

[73] Assignee: Champion International Corporation, Stamford, Conn.

[21] Appl. No.: 85,787

[22] Filed: Oct. 17, 1979

[51] Int. Cl.[3] ..... B65D 5/42; B65D 25/00

[52] U.S. Cl. ..... 229/41 R; 206/45.31

[58] Field of Search ..... 206/45.31, 45.33, 497; 229/41, 39 B; 220/33

[56] References Cited

U.S. PATENT DOCUMENTS

| | | | |
|---|---|---|---|
| 2,637,482 | 5/1953 | Broderick | 229/41 B X |
| 2,643,813 | 6/1953 | Vines | 229/41 B X |
| 2,984,401 | 5/1961 | Herkender | 229/41 B |
| 3,005,584 | 10/1961 | Coe | 229/41 B X |
| 3,113,712 | 12/1963 | Kindseth | 220/461 X |
| 3,386,644 | 6/1968 | Zackheim | 229/41 B |
| 3,819,035 | 6/1974 | Jaeschke | 206/45.31 X |
| 4,083,447 | 4/1978 | Walters et al. | 229/41 B X |
| 4,210,240 | 7/1980 | Fricano | 229/37 R X |

*Primary Examiner*—Davis T. Moorhead

*Attorney, Agent, or Firm*—Evelyn M. Sommer

[57] ABSTRACT

A self opening container which is shipped in a flat condition and erected with one hand without manual contact with the inner container surfaces. By applying a force to the sides of the flat package, the cover and base separate and the end walls of the base lock into an opening in the cover to provide a three dimensional container.

5 Claims, 7 Drawing Figures

SELF OPENING CARTON

BACKGROUND OF THE INVENTION

Paperboard cartons are used for a wide variety of applications. Many of them are formed from a single blank of paperboard and then folded, tubed and erected to form a three dimensional container for holding the desired product. It is important, where possible, that the containers be shipped from the manufacturer to the user as a flat package in order to conserve space and shipping costs. The manufacturer then runs the flat packages through a machine which tubes and erects the cartons and fills them with the product.

There are circumstances, however, where the flat packages must be handled manually and yet during the process of erecting the flat packages into a three dimensional container, there must not be any manual contact with the inner container surfaces. Such containers may be used in chemical laboratories or in experiments wherein a product or sample must be placed in a sterilized container manually. It is normally required to use both hands to transform the flat package into a tubed, erected, three dimensional container. In such cases, however, it is also difficult to prevent manual contact with the inner container surfaces.

SUMMARY OF THE INVENTION

It is an object of the present invention to provide a container which is shipped in the flat state and, when necessary to erect the flat package into a three dimensional container, force is applied to both sides of the package, by one hand for example, and the flat package erects itself into a three dimensional container.

Thus, the present invention relates to a container for being shipped as a flat package and erected to form a three dimensional container by applying a force to the sides of said flat package comprising a base, a cover superimposed over said base to form a flat, rectangular package for shipping and means formed with said base and said cover in operative relationship to form a three dimensional container from said flat package when force is applied to the sides of said flat package.

The invention also relates to a method of forming a three dimensional container from a flat package comprising the steps of forming a container base having end walls and side walls and a cover in a superimposed relationship with said base, and forming means in said base and said cover for erecting said end walls and side walls by applying force to each side of said flat package.

The invention also relates to a blank for forming a container to be shipped in a flat state and erected with one hand comprising a cover having a glue flap integrally formed on one edge thereof, a guide panel formed on and integrally attached to each end thereof and an opening formed therein, and a base having a bottom wall, side and end walls hingedly attached to said bottom wall, a webb hingedly connecting each corner formed by a side wall and an adjacent end wall and a lip on the outer edge of said end wall projecting beyond said connecting webb.

BRIEF DESCRIPTION OF THE DRAWINGS

These and other objects and advantages of the present invention will be disclosed in the course of the following specification, reference being had to the accompanying drawings in which.

DESCRIPTION OF THE PREFERRED EMBODIMENT

Figure 1:
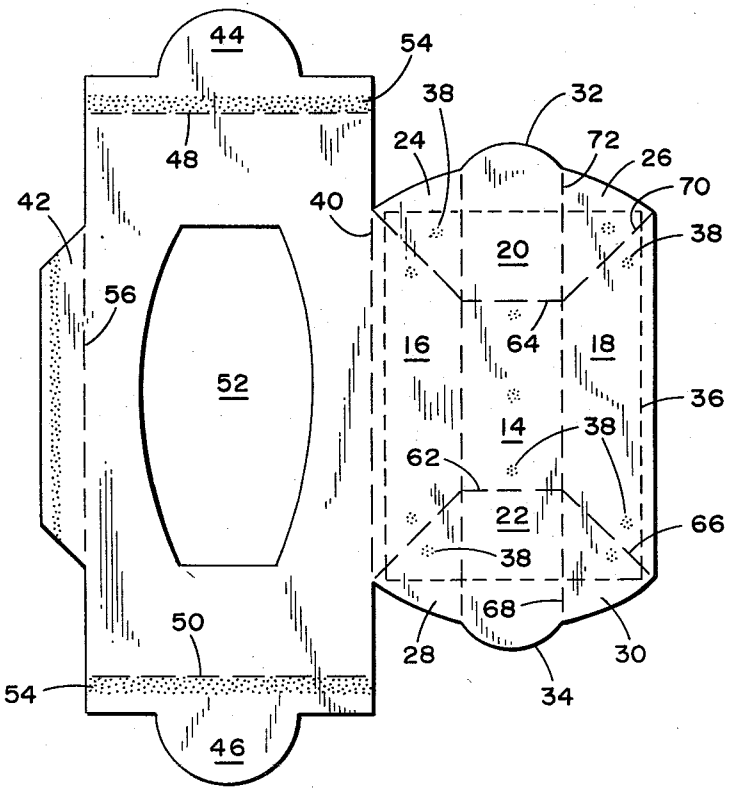
FIG. 1 is a plan view illustrating a blank from which the preferred embodiment of the present inventive container may be constructed.

FIG. 1 is a plan view of a paperboard blank from which the novel container of the present invention may be formed. It comprises a base 10 and a cover 12. The base has a bottom wall 14, side walls 16 and 18, end walls 20 and 22, and webbs 24, 26, 28 and 30, each of which has an arcuate outer end and which hingedly connects each corner formed by a side wall and an adjacent end wall. Further, lips 32 and 34 are integrally formed with and project from the outer edge of each end wall beyond the outer edge of the webbs 24, 26, 28 and 30. These lips 32 and 34 will serve as the locking means to hold the carton in its three dimensional state when it is fully erected. If desired, a flexible, liquid-tight seal 36 (shown in dashed lines) such as cellophane may be attached to base 10 by means of glue spot 38 or other well-known means whereby the container is liquid-tight in the erected state.

Cover 12 is integrally formed with and hingedly attached along hinge line 40 to base 10. Cover 12 has integrally formed therewith a glue flap 42 and guide panels 44 and 46 on each end thereof. Guide panels 44 and 46 are hingedly attached to said cover 12 along score lines 48 and 50, respectively. An opening 52 is also formed in the cover 12 so that when the carton is in its three dimensional state, products can be introduced therein through said opening.

Figure 2:
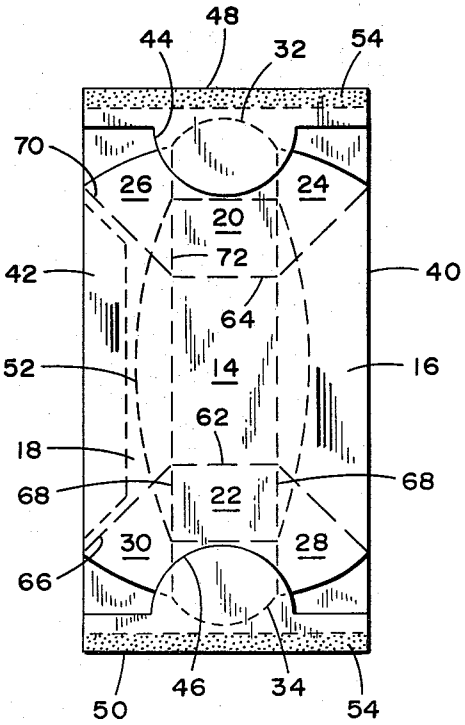
FIG. 2 is a bottom view of the folded blank of FIG. 1 illustrating the container as a flat package ready for shipping.

FIG. 2 is a plan view of the bottom of the container folded into a flat package ready for shipping. Thus, in the blank of FIG. 1, the base 10 is folded to the left about score line 40 to lie on top of and be superimposed over cover 12. Glue flap 42 is then folded about score line 56 and fastened to the base 10. Guide panels 44 and 46 have glue strip 54 thereon and each is folded about score line 48 and 50, respectively thus overlapping end walls 20 and 22 of the base 10. For purposes of clarity of the drawings, the liquid-tight seal 36 and glue spots 38 by which it is attached to the base 10 are not shown in FIG. 2 but could be utilized if desired in the folded container shown in FIG. 2. Thus, the package shown in FIG. 2 is flat and ready for shipping for a user.

Figure 3:
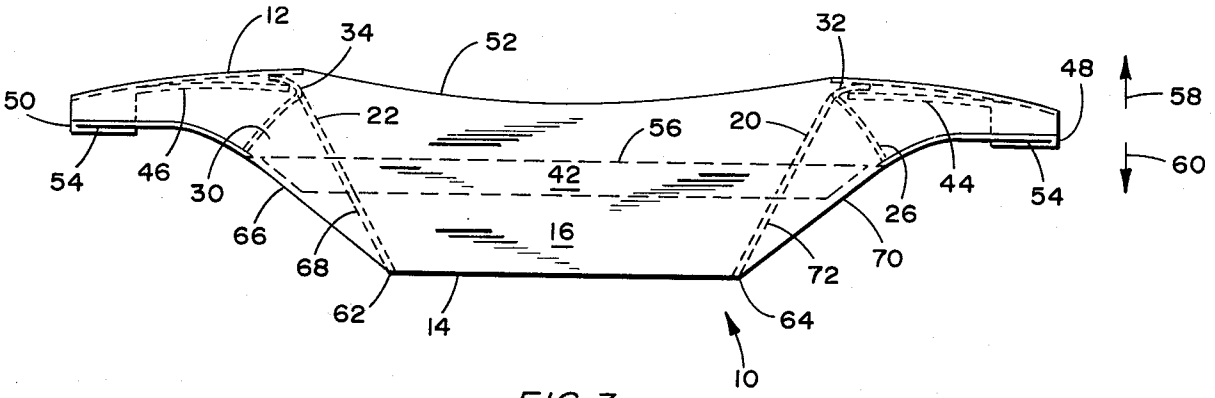
FIG. 3 is a side view of a container formed from the blank of FIG. 1 with the container in its partially opened state.

FIG. 3 is a side view of the flat package shown in FIG. 2 after a force has been applied to the edges 40 and 56 and the carton is not yet in its fully erected state. If a pressure is applied inwardly on each of the sides, the top or cover 12 and the base 10 begin to separate in the direction shown by arrows 58 and 60. However, because end walls 20 and 22 are under and partially covered by guide panels 44 and 46, they are prevented from moving downwardly and thus pivot upwardly about score lines 62 and 64. As end walls 20 and 22 become more perpendicular with respect to bottom wall 14, webbs 26 and 30 pivot about respective score lines 70, 72 and 66, 68 which allows the side walls 18 and 16 to become more vertical with respect to end walls 20 and 22.

As continued pressure is applied to the sides 40 and 56 of the flat package, outer lips 32 and 34 of end walls 20 and 22 respectively slip entirely out from under guide panels 44 and 46 whereby the projecting lips 32 and 34 extend through said cover opening 52 thereby locking the container in its three dimensional erected state. This is shown in detail in FIG. 4.

Figure 4:
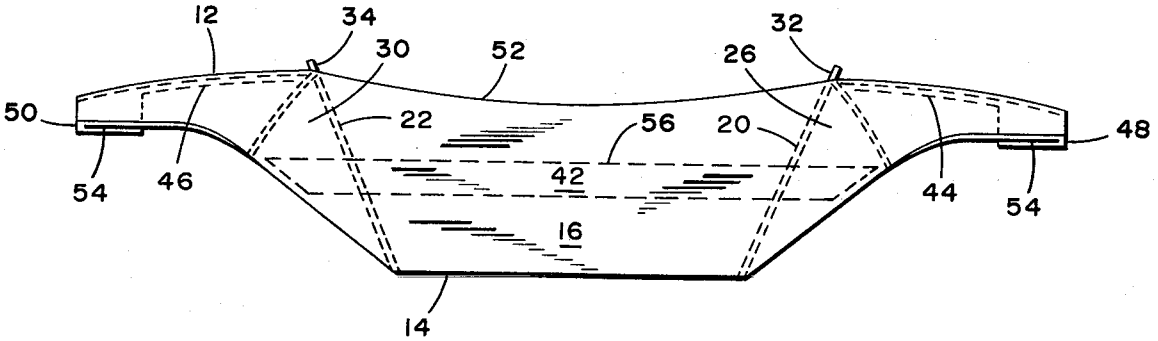
FIG. 4 is a side view of the container formed from the blank of FIG. 1 and illustrating the carton in its fully opened state wherein it is locked in the erected state and cannot collapse.

Thus, it can be seen that the container blank shown as a flat package in FIG. 2 can be erected into its three dimensional state shown in FIG. 4 simply by using one hand to apply pressure to each of the sides 40 and 56 thereby causing the flat package to snap into a three dimensional container that is locked in its fully erected position. The package thus is extremely valuable for use under sanitary conditions where there is to be no manual contact with the inner walls of the container.

Figure 5:
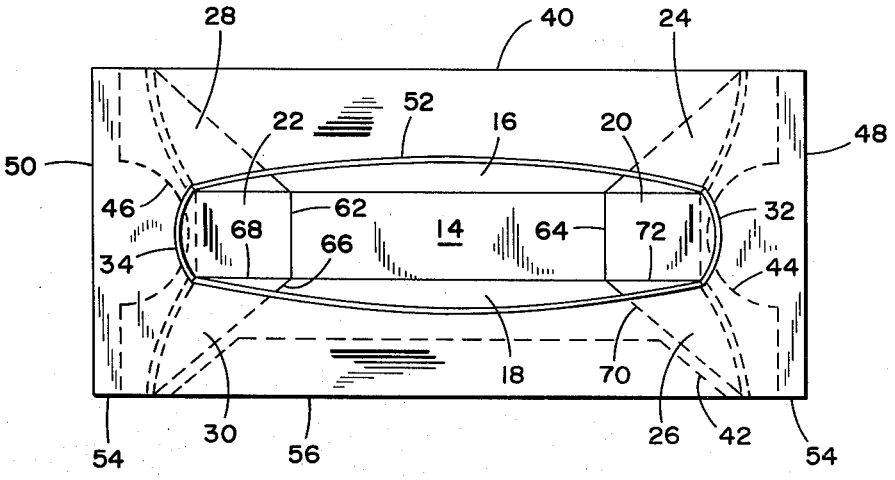
FIG. 5 is a top view of a container formed from the blank of FIG. 1 and shown in its fully erected state.

FIG. 5 is a top view of the fully erected container shown in FIG. 4. The container bottom wall 14, side walls 16 and 18 and end walls 20 and 22 can be seen by looking through the opening 52 in the top of the container. As can be seen in FIG. 5, the lips 32 and 34 of each of the end walls 20 and 22, respectively project through cover opening 52 thereby locking the container in its three dimensional erected state. Thus, the desired product to be held by the container can be inserted through cover opening 52. Also, as stated earlier, if the liquid-tight seal such as cellophane is applied to the base 10 as shown in FIG. 1, the container of FIG. 5 can then hold a liquid so long as it does not exceed in depth the depth of the side and end walls covered by the liquid-tight seal.

Figure 6:
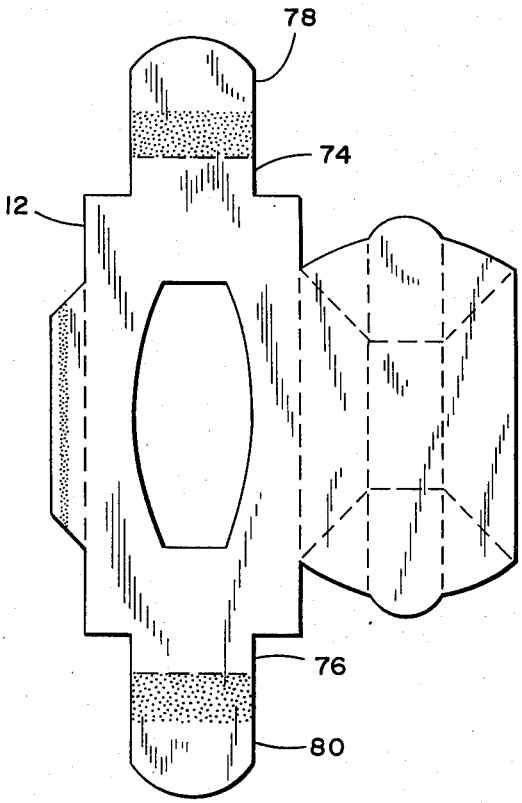
FIG. 6 is a plan view illustrating a blank from which an alternate embodiment of the present invention container may be formed.
Figure 7:
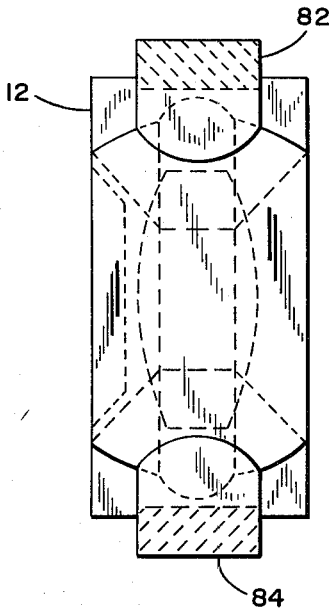
FIG. 7 is a bottom view of the folded blank of FIG. 6 forming a flat package ready for shipping.

It will also be noted in FIGS. 3, 4 and 5 that the outer ends of the cover 12 form handle-like shoulders which can be used to transport the container once it is filled. If longer handles are desired, the embodiment shown in FIG. 6 and FIG. 7 may be used. In this embodiment, shoulders 74 and 76 are added to the ends of cover 12 and the guide panels 78 and 80 are elongated so that when they are folded over and glued at 82 and 84 as shown in FIG. 7 there is a projection from each end of the cover 12 which may be used as handles. However, in all other respects, the containers are identical and the alternate embodiment disclosed in FIGS. 6 and 7 may be folded, glued and opened in the same manner as that already discussed in relation to FIGS. 1–5.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A container for being shipped as a flat package and erected to form a three dimensional container by applying a force to the sides of said flat package comprising:

a. a base, b. a cover connected to and superimposed over said base to form a flat, rectangular package for shipping, said cover being integrally formed with said base and including an opening for introducing products into said container when in the erected state, and c. means formed with said base and said cover in operative relationship to form a three dimensional container from said flat package when force is applied to the side edges of said flat package, said three dimensional forming means comprising:

1. end walls formed in said base,
2. a lip projecting from the outer edge of each end wall,
3. side walls formed in said base,
4. a web formed in said base and hingedly connecting each corner formed by a side wall and an adjacent end wall, and
5. a guide panel formed with each end of said cover and each folded under said cover to overlap a portion of each of said end walls whereby said end wall panel lip is forced upwardly as said cover and base separate when a force is applied to the side edges of said flat package thereby forming a three dimensional container.

2. A container as in claim 1 further including means for locking said container in its erected state.

3. A container as in claim 1 further including a flexible, liquid-tight seal attached to said base between said base and said cover whereby said container is liquid-tight in the erected state.

4. A container as in claim 1 wherein said locking means comprises said lip of said end walls projecting through said cover opening thereby locking said container in its three dimensional erected state.

5. A container as in claim 4 formed from a unitary paperboard blank.

* * * * *